US006427604B1

(12) United States Patent
Chrobak

(10) Patent No.: US 6,427,604 B1
(45) Date of Patent: Aug. 6, 2002

(54) CONVERTIBLE TABLE SYSTEM

(76) Inventor: Jerome S. Chrobak, 10976 Ivy Hill Dr., #1, San Diego, CA (US) 92131

( * ) Notice: Subject to any disclaimer, the term of this patent is extended or adjusted under 35 U.S.C. 154(b) by 0 days.

(21) Appl. No.: 09/693,440

(22) Filed: Oct. 20, 2000

(51) Int. Cl.[7] ..... A47B 85/00
(52) U.S. Cl. ..... 108/12; 108/157.16
(58) Field of Search ..... 108/12, 19, 11, 108/157.1, 157.16

(56) References Cited

U.S. PATENT DOCUMENTS 2,636,794 A * 4/1953 Sternkopf
3,087,442 A * 4/1963 Berliner
3,361,088 A * 1/1968 Hodgkin
3,783,799 A * 1/1974 Dupuis ..... 108/19
3,967,562 A * 7/1976 Anacker ..... 108/12
4,106,413 A * 8/1978 Hoaglund ..... 108/12
4,109,588 A * 8/1978 Powers ..... 108/12
4,237,795 A * 12/1980 Parker ..... 108/12
4,903,614 A * 2/1990 Johnson ..... 108/19
6,000,343 A * 12/1999 Laney ..... 108/12

* cited by examiner

*Primary Examiner*—Jose V. Chen
(74) *Attorney, Agent, or Firm*—Joseph N. Breaux

(57) ABSTRACT

A convertible table system that is convertible between a coffee table configuration and a kitchen table configuration. The convertible table system includes two identical leg assemblies and a table top assembly.

1 Claim, 2 Drawing Sheets

FIG.1
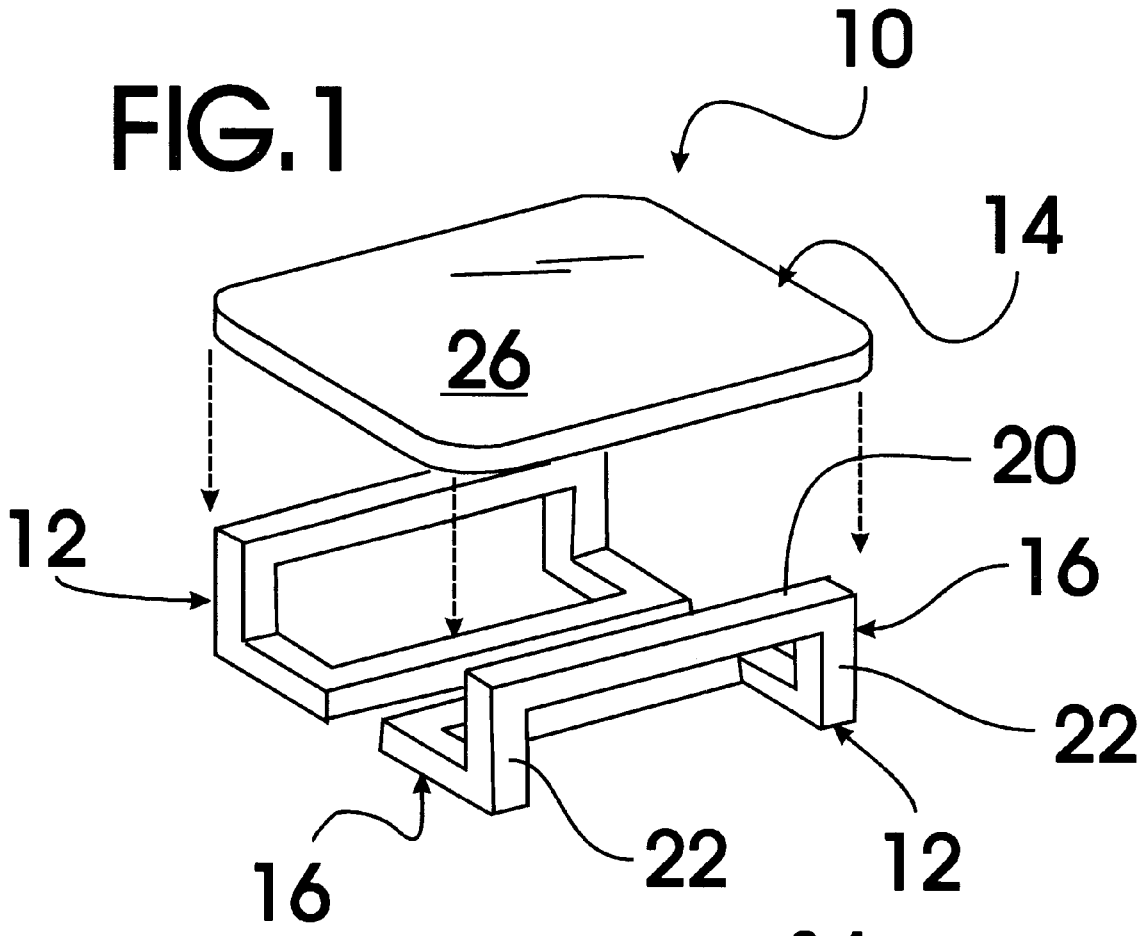
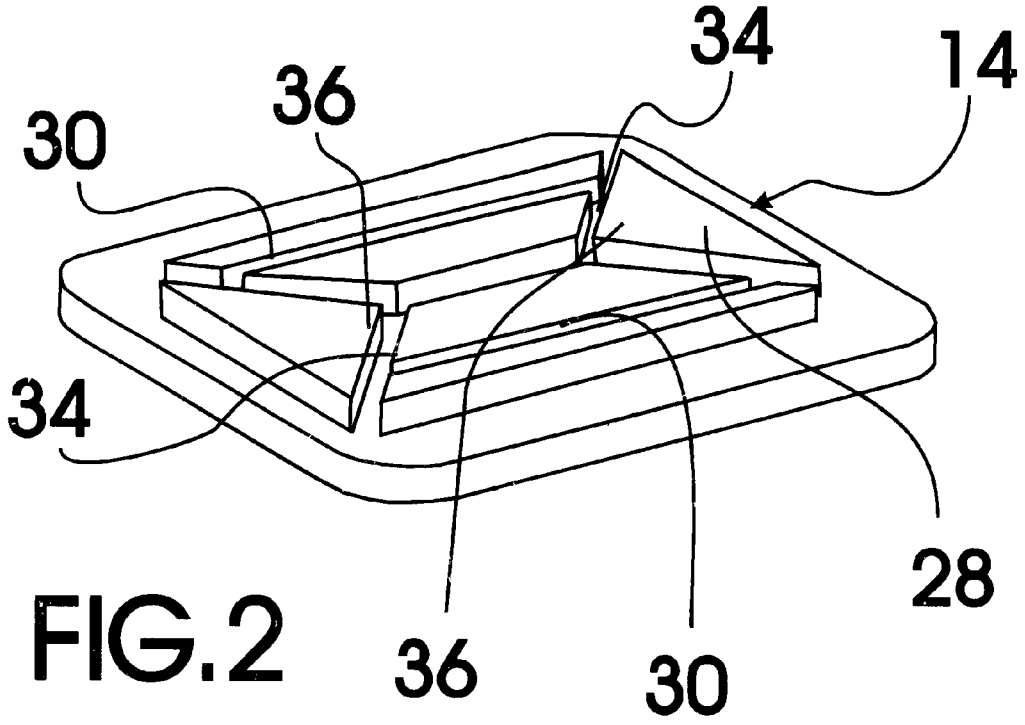
FIG.2

FIG.4
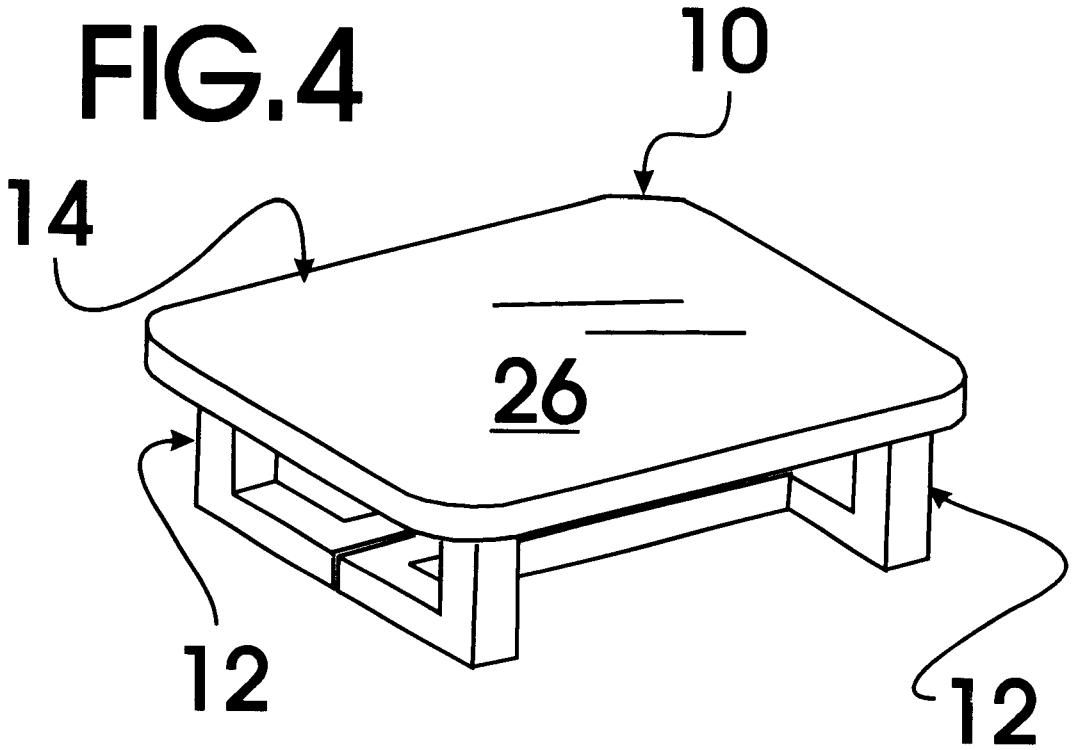
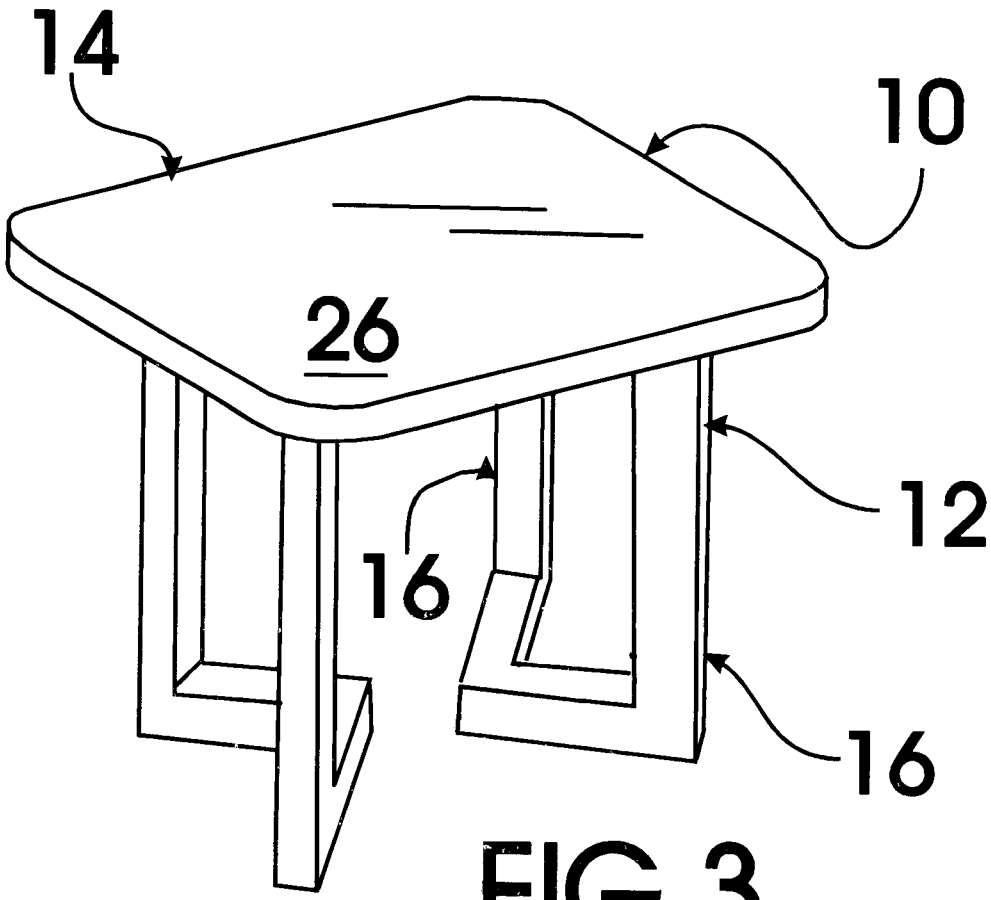
FIG.3

CONVERTIBLE TABLE SYSTEM

TECHNICAL FIELD

The present invention relates to multi-use furniture items and more particularly to a convertible table system that includes two identical leg assemblies and a table top assembly; each leg assembly including two leg member connected at right angles such that the leg members are oriented at a ninety degree angle with respect to each other, each leg member including an elongated long leg portion rigidly connected between two parallel oriented short leg portions; each short leg portion of each leg member being connected to a separate short leg portion of the other leg member such that the long leg portion of each leg member is oriented in parallel with the long leg portion of the other leg member; the table top assembly having a planar top surface and a bottom surface provided with parallel channels therein for receiving one of the long leg portions of each of the two leg assemblies to support the table top in a coffee table configuration and a pair of right angled channels formed therein with the vertex of each right angle channel oriented toward the vertex of the other right angled channel such that two connected short leg portions of each leg assembly are positionable within each right angled channel to support the table top in a kitchen table configuration.

BACKGROUND ART

Many individuals with limited living space find themselves with insufficient seating facilities when guests are present. It would be a benefit to these individuals to have a convertible table system that allowed them to use the table in coffee table configuration and then rapidly converted into a kitchen table configuration to provide additional dining facilities for guests.

GENERAL SUMMARY DISCUSSION OF INVENTION

It is thus an object of the invention to provide a convertible table system that includes two identical leg assemblies and a table top assembly; each leg assembly including two leg member connected at right angles such that the leg members are oriented at a ninety degree angle with respect to each other, each leg member including an elongated long leg portion rigidly connected between two parallel oriented short leg portions; each short leg portion of each leg member being connected to a separate short leg portion of the other leg member such that the long leg portion of each leg member is oriented in parallel with the long leg portion of the other leg member; the table top assembly having a planar top surface and a bottom surface provided with parallel channels therein for receiving one of the long leg portions of each of the two leg assemblies to support the table top in a coffee table configuration and a pair of right angled channels formed therein with the vertex of each right angle channel oriented toward the vertex of the other right angled channel such that two connected short leg portions of each leg assembly are positionable within each right angled channel to support the table top in a kitchen table configuration.

Accordingly, a convertible table system is provided. The convertible table system includes two identical leg assemblies and a table top assembly; each leg assembly including two leg member connected at right angles such that the leg members are oriented at a ninety degree angle with respect to each other, each leg member including an elongated long leg portion rigidly connected between two parallel oriented short leg portions; each short leg portion of each leg member being connected to a separate short leg portion of the other leg member such that the long leg portion of each leg member is oriented in parallel with the long leg portion of the other leg member; the table top assembly having a planar top surface and a bottom surface provided with parallel channels therein for receiving one of the long leg portions of each of the two leg assemblies to support the table top in a coffee table configuration and a pair of right angled channels formed therein with the vertex of each right angle channel oriented toward the vertex of the other right angled channel such that two connected short leg portions of each leg assembly are positionable within each right angled channel to support the table top in a kitchen table configuration.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is an exploded perspective view of an exemplary embodiment of the convertible table system showing the two identical leg assemblies and the table top assembly; each leg assembly including two leg member connected at right angles such that the leg members are oriented at a ninety degree angle with respect to each other, each leg member including an elongated long leg portion rigidly connected between two parallel oriented short leg portions; each short leg portion of each leg member being connected to a separate short leg portion of the other leg member such that the long leg portion of each leg member is oriented in parallel with the long leg portion of the other leg member; the table top assembly having a planar top surface and a bottom surface provided with parallel channels therein for receiving one of the long leg portions of each of the two leg assemblies to support the table top in a coffee table configuration and a pair of right angled channels formed therein with the vertex of each right angle channel oriented toward the vertex of the other right angled channel such that two connected short leg portions of each leg assembly are positionable within each right angled channel to support the table top in a kitchen table configuration.

FIG. 2 is a perspective view of the underside of the table top showing the two parallel channels and the pair of right angled channels.

FIG. 3 is a perspective view showing the convertible table system configured in the kitchen table configuration.

FIG. 4 is a perspective view showing the convertible table system configured in the coffee table configuration.

EXEMPLARY MODE FOR CARRYING OUT THE INVENTION

FIGS. 1–4 show various aspects of an exemplary embodiment of the convertible table system of the present invention generally designated 10. Convertible table system 10 includes two identical leg assemblies, each generally designated 12, and a table top assembly, generally designated 14. Each leg assembly 12 includes two leg members, generally designated 16, connected at right angles such that the leg members 16 are oriented at a ninety degree angle with respect to each other. Each leg member 16 includes an elongated long leg portion 20 rigidly connected between two parallel oriented short leg portions 22. Each short leg portion 22 of each leg member 16 is connected to a separate short leg portion 22 of the other leg member 16 such that the long leg portion 20 of each leg member 16 is oriented in parallel orientation with the long leg portion 20 of the other leg member 16.

Table top assembly 14 has a planar top surface 26 and a bottom surface 28 provided with two parallel channels 30 therein for receiving one of the long leg portions 20 of each of the two leg assemblies 12 to support table top 14 in a coffee table configuration and a pair of right angled channels 34 formed therein with the vertex 36 of each right angle channel 34 oriented toward the vertex 36 of the other right angled channel 34 such that two connected short leg portions 22 of each leg assembly 12 are positionable within each right angled channel 34 to support the table top 14 in a kitchen table configuration.

It can be seen from the preceding description that a convertible table system has been provided.

It is noted that the embodiment of the convertible table system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A convertible table system comprising:

two identical leg assemblies; and a table top assembly;

each leg assembly including two leg members connected at right angles such that the leg members are oriented at a ninety degree angle with respect to each other, each leg member including an elongated long leg portion rigidly connected between two parallel oriented short leg portions;

each short leg portion of each leg member being connected to a separate short leg portion of the other leg member such that the long leg portion of each leg member is oriented in parallel with the long leg portion of the other leg member;

the table top assembly having a planar top surface and a bottom surface provided with parallel channels therein for receiving one of the long leg portions of each of the two leg assemblies to support the table top in a coffee table configuration and a pair of right angled channels formed therein with a vertex of each right angle channel oriented toward a vertex of the other right angled channel such that two connected short leg portions of each leg assembly are positionable within each right angled channel to support the table top in a kitchen table configuration.

* * * * *